US005466213A

United States Patent [19]

Hogan et al.

[11] Patent Number: 5,466,213

[45] Date of Patent: Nov. 14, 1995

[54] INTERACTIVE ROBOTIC THERAPIST

[75] Inventors: Neville Hogan, Sudbury; Hermano I. Krebs, Somerville; Andre Sharon, Newton; Jain Charnnarong, Charleston, all of Mass.

[73] Assignee: Massachusetts Institute of Technology, Cambridge, Mass.

[21] Appl. No.: 178,182

[22] Filed: Jan. 6, 1994

Related U.S. Application Data

[63] Continuation-in-part of Ser. No. 87,666, Jul. 6, 1993, abandoned.

[51] Int. Cl.[6] ..... A61H 1/00

[52] U.S. Cl. ..... 601/33; 482/901; 482/4

[58] Field of Search ..... 601/33, 34, 40; 414/5; 901/4; 482/1, 4–9, 901, 902, 900

[56] References Cited

U.S. PATENT DOCUMENTS

| | | | |
|---|---|---|---|
| 3,648,143 | 3/1972 | Harper et al. | 901/4 |
| 4,046,262 | 9/1977 | Vykukal et al. | 414/5 |
| 4,235,437 | 11/1980 | Ruis et al. | 482/137 |
| 4,689,449 | 8/1987 | Rosen . | |
| 4,740,126 | 4/1988 | Richter | 901/4 |
| 4,837,734 | 6/1989 | Ichikawa et al. | 901/4 |
| 4,936,299 | 6/1990 | Erlandson | 601/33 |
| 5,020,790 | 6/1991 | Beard et al. . | |
| 5,078,152 | 1/1992 | Bond et al. | 482/902 |
| 5,163,451 | 11/1992 | Grellas | 601/33 |
| 5,186,695 | 2/1993 | Mangseth et al. | 482/4 |
| 5,201,772 | 4/1993 | Maxwell . | |
| 5,391,128 | 2/1995 | deBear | 482/4 |

FOREIGN PATENT DOCUMENTS

| | | | |
|---|---|---|---|
| 676280 | 7/1979 | U.S.S.R. | 601/33 |
| 876131 | 10/1981 | U.S.S.R. | 601/33 |
| 9313916 | 7/1993 | WIPO | 901/4 |

OTHER PUBLICATIONS

Adelstein, B. D. and Rosen, M. J., "A Two Degree–of–Freedom Loading Manipulandum for the Study of Human Arm Dynamics," 1987 Advances in Bioengineering, The American Society of Engineers, pp. 111–112 (1987, Dec.).

Rosen, M. J. and Adelstein, B. D., "Design of a Two–Degree–of–Freedom Manipulandum for Tremor Research," Frontiers of Engineering and Computing in Health Care–1984, IEEE Engineering in Medicine and Biology Society, pp. 47–51 (1984, Sep.).

Adelstein, B. D. and Rosen, M. J., "A High Performance Two Degree–of–Freedom Kinesthetic Interface," Proceedings of the Eng. Foundation Conf. on Human Machine Interfaces for Teleoperators and Virtual Environments, 6 pages, (1990, Mar.).

*Primary Examiner*—Joe H. Cheng
*Assistant Examiner*—Jeanne M. Clark
*Attorney, Agent, or Firm*—Hamilton, Brook, Smith & Reynolds

[57] ABSTRACT

An interactive robotic therapist interacts with a patient to shape the motor skills of the patient by guiding the patient's limb through a series of desired exercises with a robotic arm. The patient's limb is brought through a full range of motion to rehabilitate multiple muscle groups. A drive system coupled to the robotic arm is controlled by a controller which provides the commands to direct the robotic arm through the series of desired exercises.

20 Claims, 20 Drawing Sheets

INTERACTIVE ROBOTIC THERAPIST

This invention was made with government support under Grant Number 8914032-BCS awarded by the National Science Foundation. The government has certain rights in the invention.

RELATED APPLICATION

This application is a Continuation-in-Part of U.S. patent application Ser. No. 08/087,666 filed on Jul. 6, 1993 now abandoned.

BACKGROUND OF THE INVENTION

When a patient undergoes massive trauma such as a stroke, head injury, or spinal cord injury, the patient's motor skills in multiple muscle groups are impaired and the patient loses the full range of motion in the limbs. The patient must undergo physical and occupational therapy (from now on referred as therapy) in order to rehabilitate the impaired motor skills. Current therapy machines having one degree of freedom for rehabilitating single muscle groups are limited in the rehabilitation process because the range of motions needed for rehabilitation require the rehabilitation of multiple muscle groups (Functional Rehabilitation). The therapist must interact one-on-one with the patient and lead the patient through exercises having full range of motion.

SUMMARY OF THE INVENTION

The problem with employing a therapist to work one-on-one with a patient is that the therapist can only work with one patient at a time and must physically lead the patient through the exercises. Additionally, during a session, the therapist must be physically present at all times when the patient requires therapy. Furthermore, a patient's progress is very difficult to determine and quantify. Accordingly, there is a need for a therapy apparatus which allows a therapist to rehabilitate multiple patients at once, train therapists, permit remote sessions or autonomous recapitulation of a session, does not require the therapist's attention at all times during therapy, and quantifies the patient's performance and progress, permitting the session to be tailored to the patient's needs using the therapeutical procedure that maximizes the rate of recovery.

The present invention provides an interactive robotic therapist and method including a moveable member for interacting with a patient to shape the patient's motor skills. The moveable member is capable of guiding a patient's limb through a series of desired exercises. The moveable member is driven by a drive system which is coupled to the moveable member. The power output of the drive system is controlled so that the patient can alter the path of the series of exercises guided by the moveable member. The drive system is controlled by a controller which provides the commands to direct the moveable member through the series of desired exercises.

In preferred embodiments, the moveable member is a robotic arm which has a series of moveable joints. The patient's arm is secured to the robotic arm. The drive system comprises at least one drive motor coupled to at least one joint in the robotic arm. The robotic arm is capable of guiding the person's arm through more than one degree of freedom. The desired series of exercises are predetermined and are entered and stored into the memory of the controller by guiding the robotic arm through a series of motions. The exercises can then be replayed to interact with a patient.

The present invention provides an interactive robotic therapist and method which allows a therapist to rehabilitate multiple patients at one time and does not require the physical presence or continuous attention of the therapist. Additionally, the therapist can provide a patient with therapy by controlling the robotic therapist with a remotely located robotic therapist.

The present invention provides an interactive robotic therapist and method which allows a simultaneous diagnosis or training of therapists through the interaction with a patient.

The present invention provides an interactive robotic therapist and method which allows the quantification of the patient recovery and progress. This is a fundamental tool to evaluate different therapeutical procedures and tailor the therapy to the patient needs.

BRIEF DESCRIPTION OF THE DRAWINGS

The foregoing and other objects, features and advantages of the invention will be apparent from the following more particular description of the drawings of the preferred embodiments. Reference characters refer to the same parts throughout the different drawings. The drawings are not necessarily to scale, emphasis instead being placed on illustrating the principles of the invention.

FIGS. 11*a*–11*d* show the implemented concepts for range of motion, force, direction and dexterity exercises.

DETAILED DESCRIPTION OF THE PREFERRED EMBODIMENTS

Figure 1:
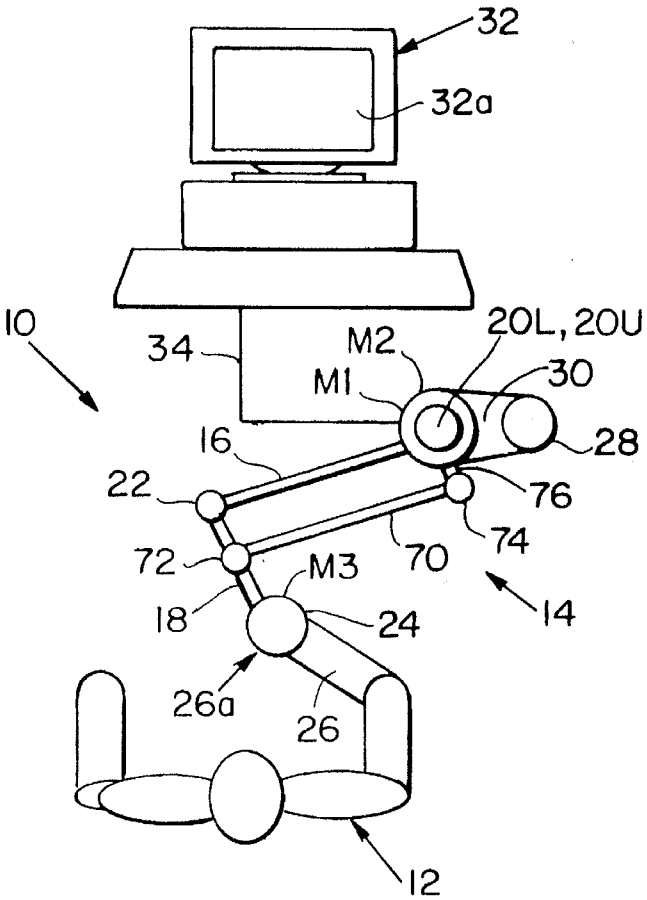
FIG. 1 is a schematic drawing of a patient interacting with the present invention interactive robotic therapist.

In FIG. 1, interactive robotic therapist 10 2D-version has a robotic arm 14 which is controlled by direct drive motors M1, M2 and M3. Robotic arm 14 is secured to a column 28 by bracket 30. Column 28 provides robotic arm 14 with vertical adjustment. Bracket 30 is secured to motor M1, which controls motion of shoulder joint 20L. Robotic arm 14 comprises an arm member 16, which is connected to the forearm member 18 by elbow joint 22, which in turn is connected to an end-effector 24. Bracket 30 is also secured to motor M2, which controls motion of the joint 20U. Joint 20U is connected to member 76, which is connected to member 70 by joint 74. Member 70 is connected to the forearm member 18 by the elbow actuation joint 72. Shoulder joint 20L and elbow joint 22 provide robotic arm 14 with motion having two degrees of freedom.

Motor M2 controls movement at elbow actuation joint 72, and is secured to bracket 30 along the same vertical axis as motor M1 in order to reduce inertia effects on the movement of robotic arm 14. Alternatively, motor M2 can be located at elbow joint 22 or other suitable locations. The forearm 26 and hand 26*a* of patient 12 is secured to end-effector 24. End-effector 24 has three degrees of freedom and can exercise the full range of motion of the wrist of patient 12. End-effector 24 is driven by motor M3 which is mounted to end-effector 24.

Motors M1, M2 and M3 are preferably direct drive high torque DC motors, which are not connected to gear reducers but alternatively can be other suitable types of motors including motors connected to gear reducers or cables. Additionally, velocity, position and force sensors are located within joints 20U and 20L, as well as within end-effector 24 for providing feedback to controller 32. Controller 32 controls the motion of robotic therapist 10 and is connected to motors M1, M2 and M3 by electrical cable 34.

Presently, the position, velocity and force of the translational degrees of freedom of robotic arm 14, as well as the end-effector are measured by standard off-the-shelf components. The controller 32 is a personal computer which for example can be a 80486 CPU having standard 16 bit A/D and D/A cards, as well as a 32 bit DIO board.

Typically, in operation, the patient is first secured to robotic therapist 10. The human therapist then teaches the robotic therapist a series of motions by moving the robotic arm 14 and end-effector 24 through simple exercises such as stretching the arm and rotating the wrist. Robotic therapist 10 records the desired movements and stores them in memory within controller 32. Robotic therapist 10 can then replay the recorded motions while guiding patient 12 with varying degrees of firmness during which the human therapist may or may not choose to be present. The varying firmness can be programmed into and controlled by controller 32 and patient 12 can override or alter the programmed path of robotic arm 14 by exerting his or her strength on robotic arm 14. To promote learning, as motor skills are acquired, firmness may be progressively reduced, thereby reducing the degree of guidance and assistance provided to the patient. As the patient 12 regains lost motor skills, the dependence on the robotic interactive therapist 10 becomes reduced. Controller 32 can keep a record of a patient's performance at each session so that the patient's progress can be followed.

Figure 2:
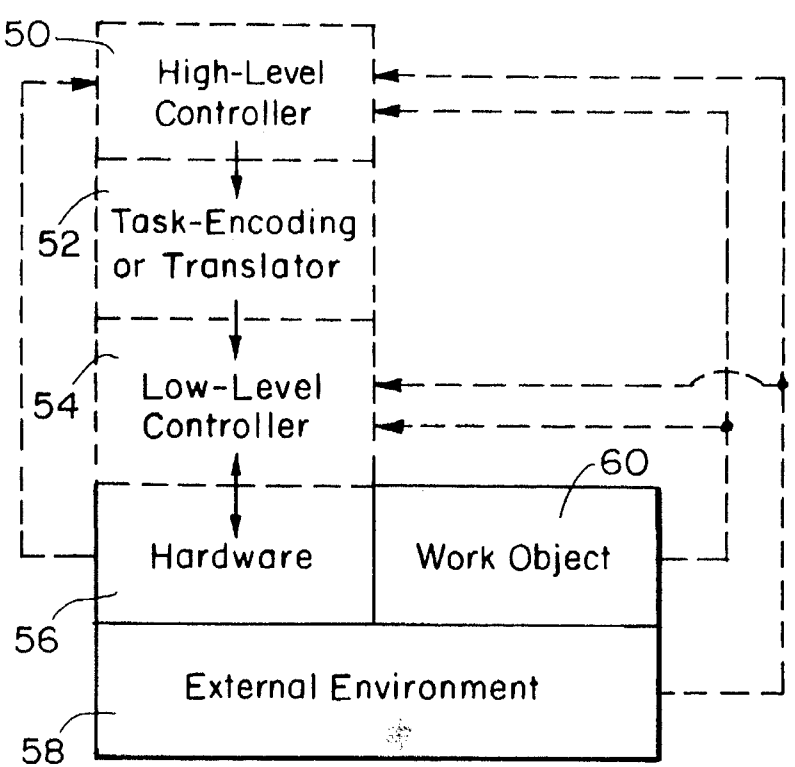
FIG. 2 is a flow chart for a preferred control system for the present invention.

Referring to FIG. 2, the control system for robotic therapist 10 is composed of a sequence of layers. The control system is organized in a hierarchy with each layer interacting with the immediately adjacent layer. The highest layer corresponds to the designated high level controller 50 followed by a layer designated as task encoding or translator 52. The lower layer designated as low level controller 54 interacts with the hardware 56. A layer on the same level of the hardware corresponds to the work object 60 and both the hardware layer and the work object layer are deposited on the external environment layer 58. The arrows show the flow of information and energetic interaction.

Figure 3A:
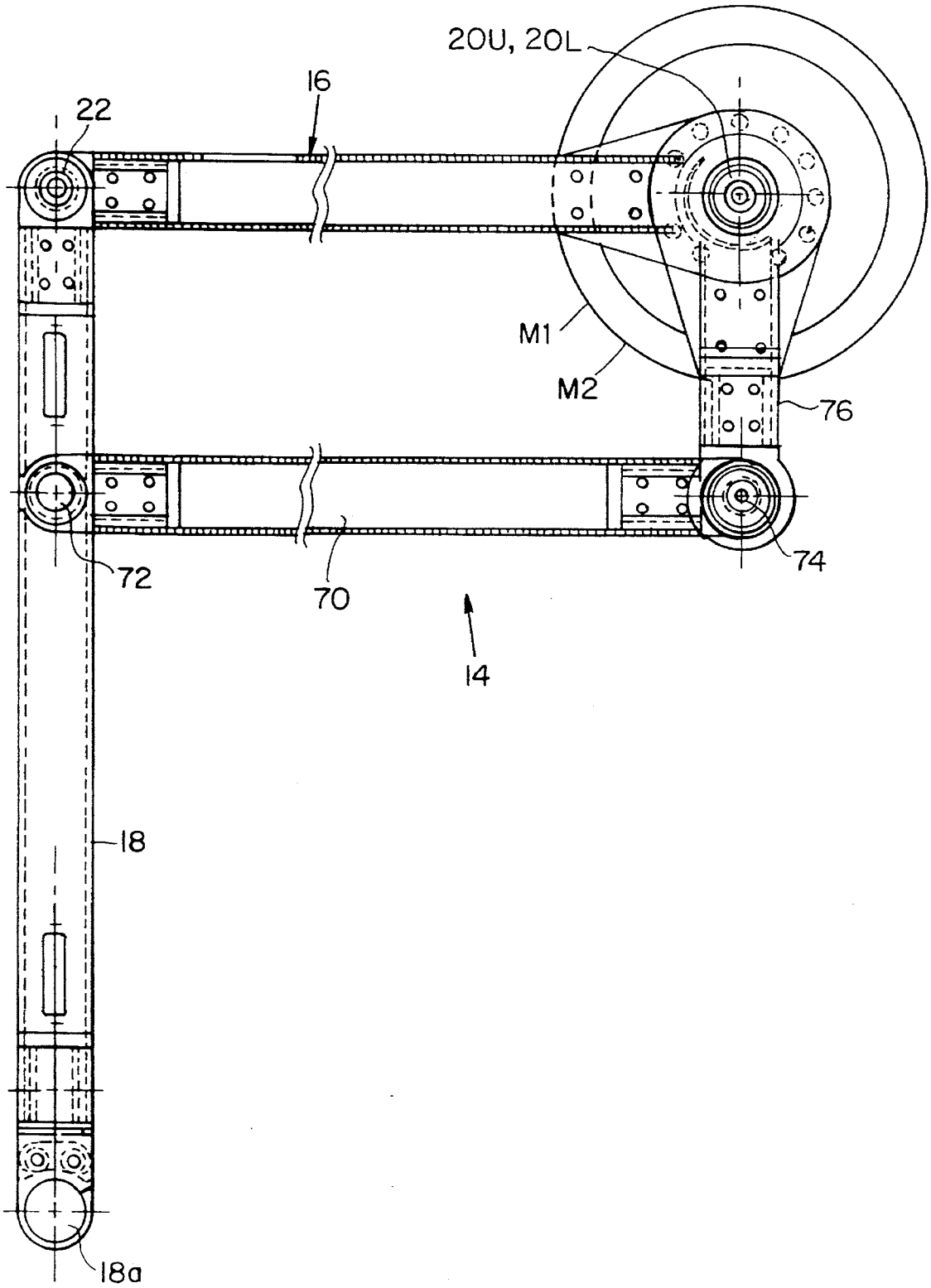
FIGS. 3*a*–3*c* are preferred embodiments of the robotic arm for planar motion version (two dimensions -2D) or spatial motion version (three dimensions - 3D).

Referring to FIG. 3*a*, one preferred embodiment of robotic arm 14 is a parallelogram linkage including arm member 16 which is connected to forearm member 18 by joint 22. Joint 20U is connected to arm member 76 which connects to forearm member 18 via joint 74, connecting member 70 and elbow actuation joint 72. Movement of arm member 16 is controlled by motor M1 and the movement of elbow actuation joint 72 is controlled by motor M2 via arm member 76, joint 74 and connecting member 70. End-effector 24 is secured to robotic arm 14 at end 18*a* of forearm member 18.

Figure 3B:
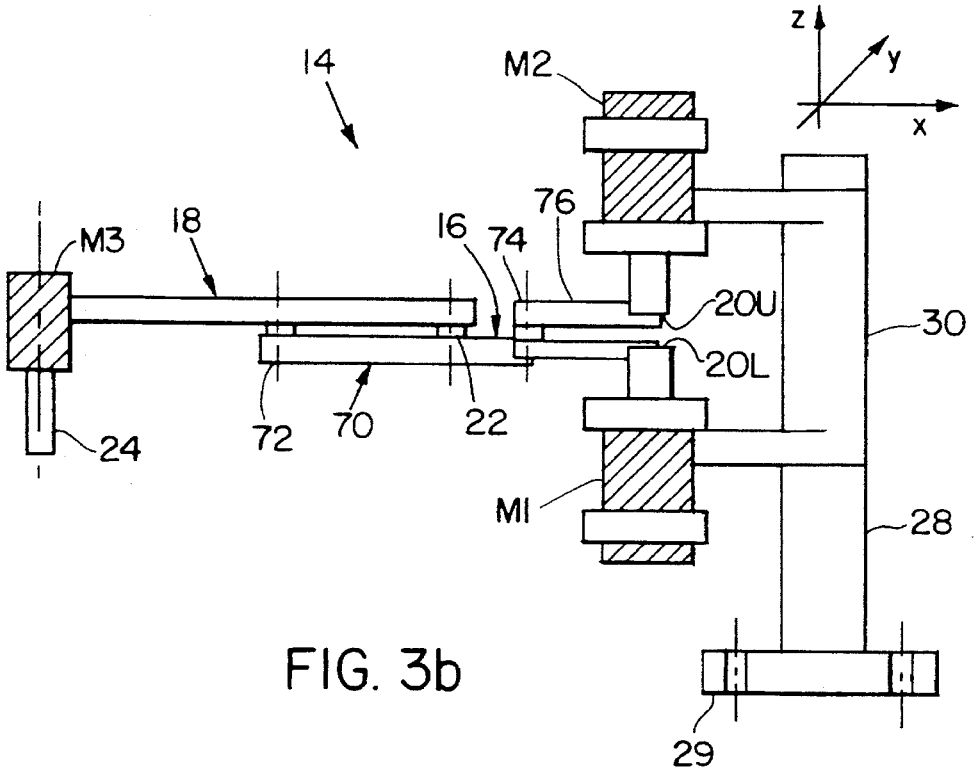
Figure 3C:
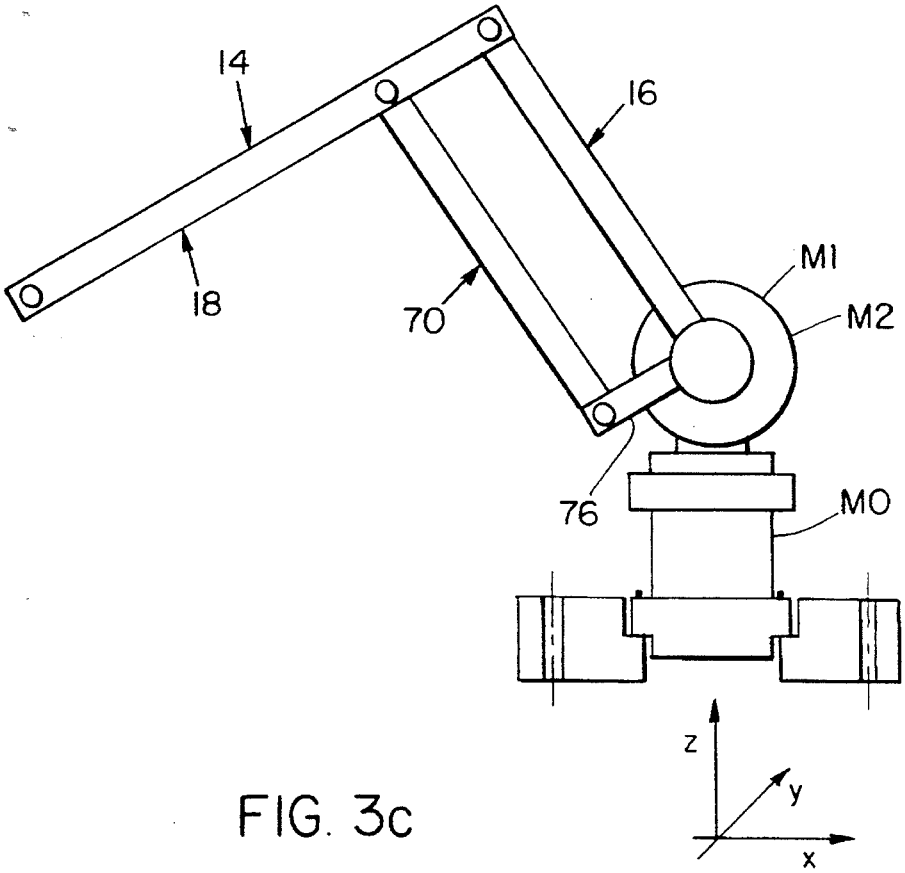

Referring to FIGS. 3*b* and 3*c*, the preferred embodiment of the robotic arm 14 of FIG. 3*a* has a modular concept. It can be assembled for 2D horizontal movement, in which case the arm 14 is assembled in the horizontal plane and the base 29 is fixed with respect to column 28 and bracket 30. It can also be assembled for 3D movement, in which case the arm 14 is assembled in the vertical plane and the base is a controlled rotational base with the motor M0.

Figure 4A:
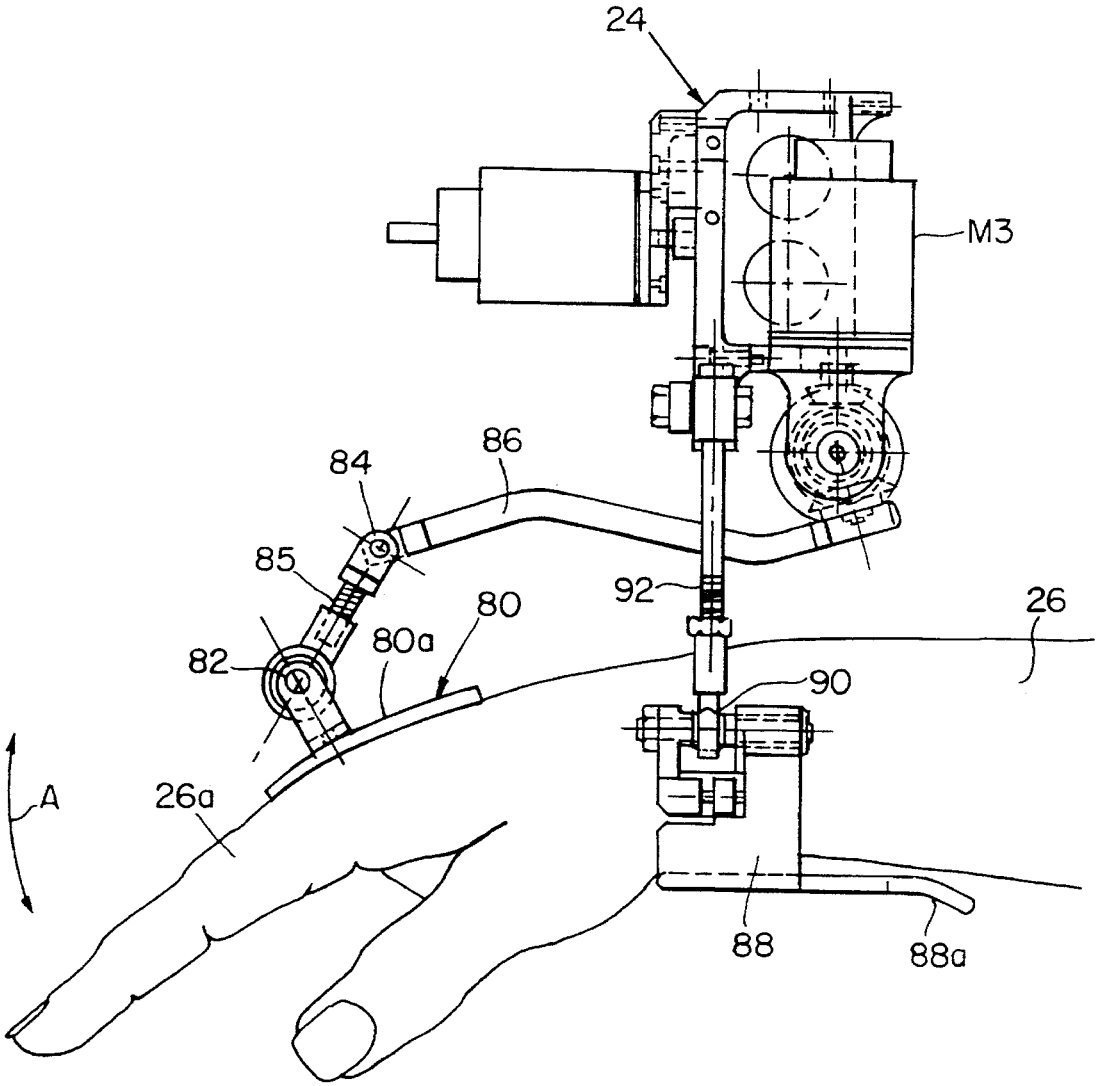
FIGS. 4*a*–4*f* show a patient's hand secured to an end-effector in various positions as seen from the side, front and top, as well as different possible attachment locations for the end-effector.

Referring to FIG. 4*a*, the forearm 26 of patient 12 is secured to end-effector 24 by splint holder 88 and splint 88*a*. Splint 88*a* is made of plastic, carbon fiber (or Kevlar™) and foam. The user can remove his or her forearm 26 by pulling the splint holder out of the connector 90. Alternatively, patient 12 can pull his forearm 26 free from the splint holder 88 by unscrewing the butterfly of splint 88*a*. A wrist flexion/extension mechanism 80 is connected to hand 26*a*. Pad 80*a* rests upon the top of hand 26 and is connected to motor M3 via joint 82, member 85, joint 84 and member 86. The wrist flexion/extension mechanism 80 is capable of moving a patient's hand 26*a* in flexion and extension postures as shown by the arrows A.

Figure 4B:
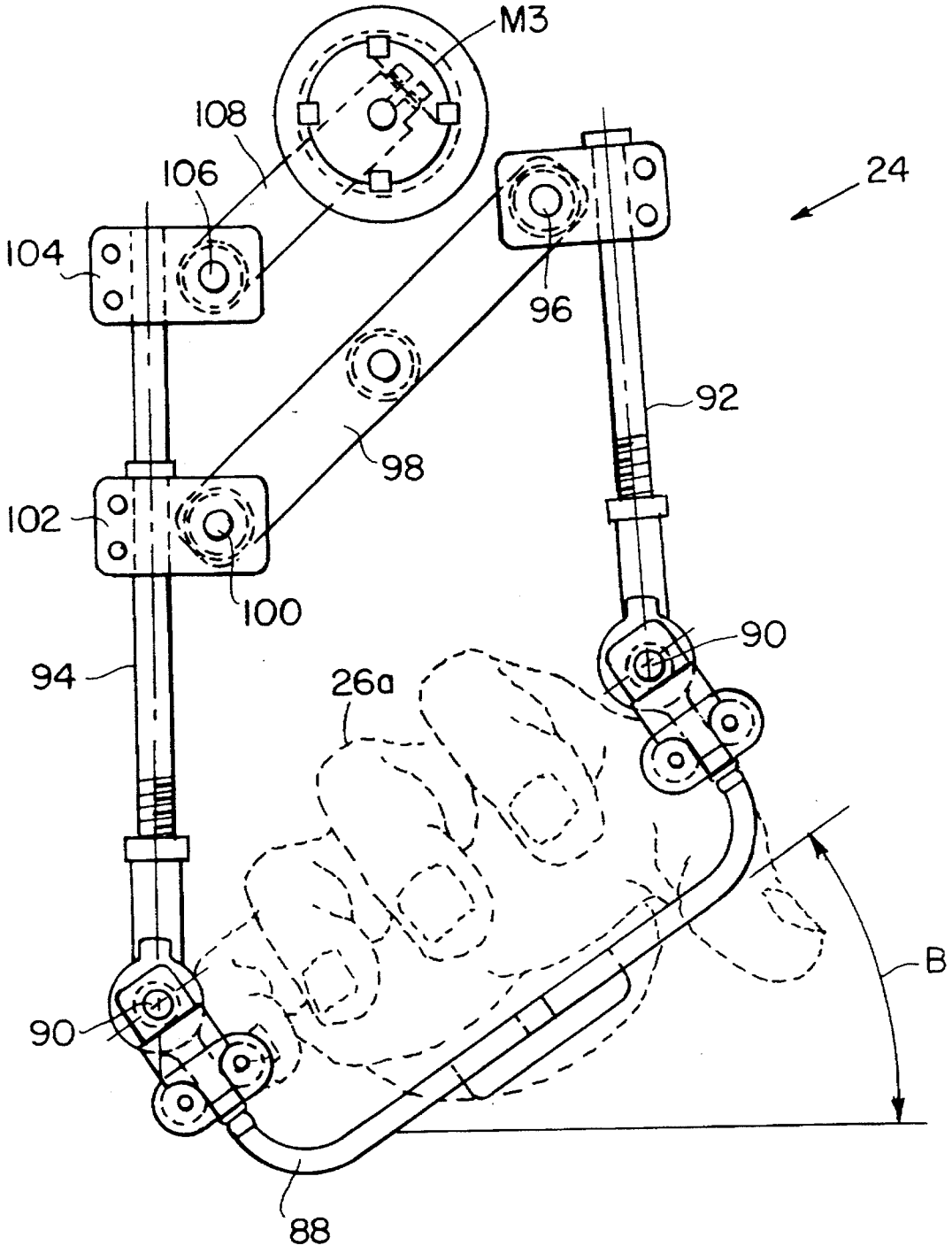

Referring to FIG. 4*b*, hand 26*a* is capable of being moved in pronation/supination postures as indicated by the arrows B. Motor M3 has a built in potentiometer and tachometer and drives an eccentric crank 108. Crank 108 is connected to a four bar mechanism comprising vertical rods 92 and 94, horizontal beam 98 and splint holder 88. Splint holder 88, rod 92, rod 94 and beam 98 are moveably connected by joints 90, 96 and 100.

Figure 4C:
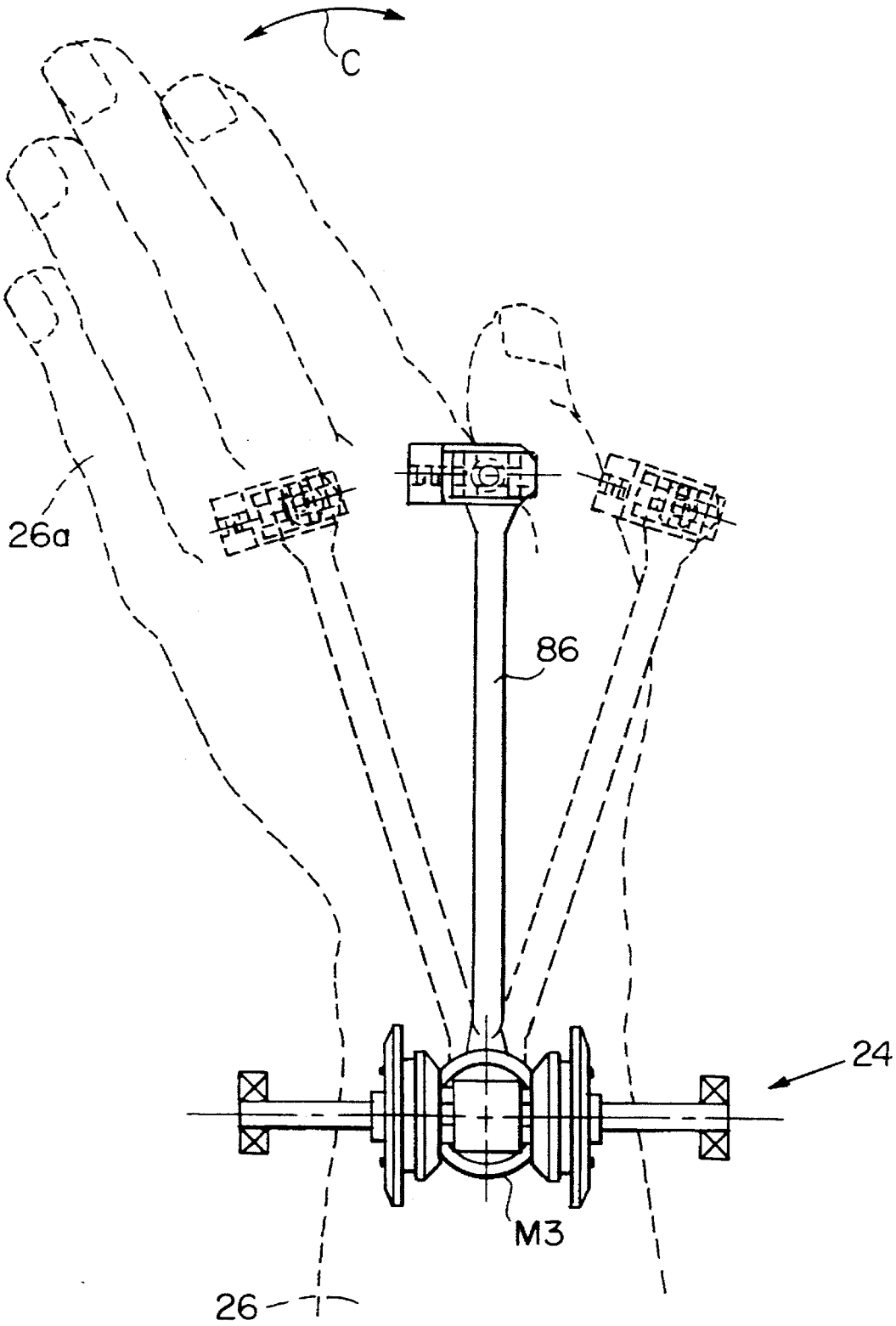

Referring to FIG. 4*c*, end-effector 24 is capable of moving the wrist in abduction and adduction postures as indicated by the arrows C. Member 86 is driven by motor M3 which moves hand 26*a* in the direction of the arrows.

Motor M3 is composed of a set of multiple motors or actuators capable of moving the wrist in 3 degrees of freedom. Additionally, end-effector 24 can be of other suitable configurations which can provide 3 degrees of freedom at the wrist.

Figure 4D:
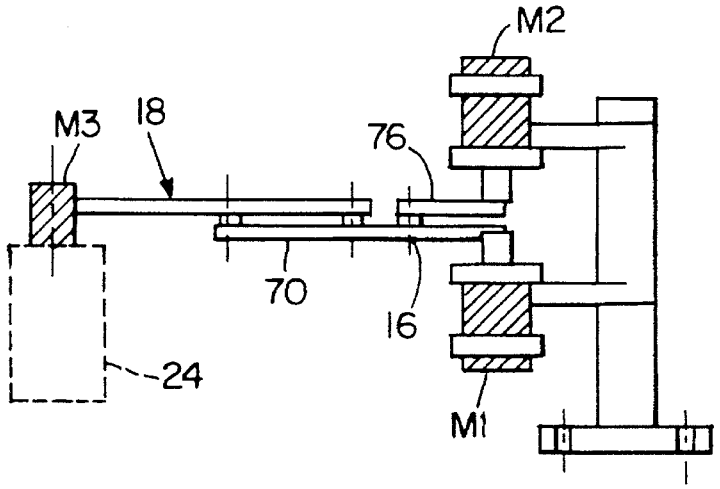
Figure 4E:
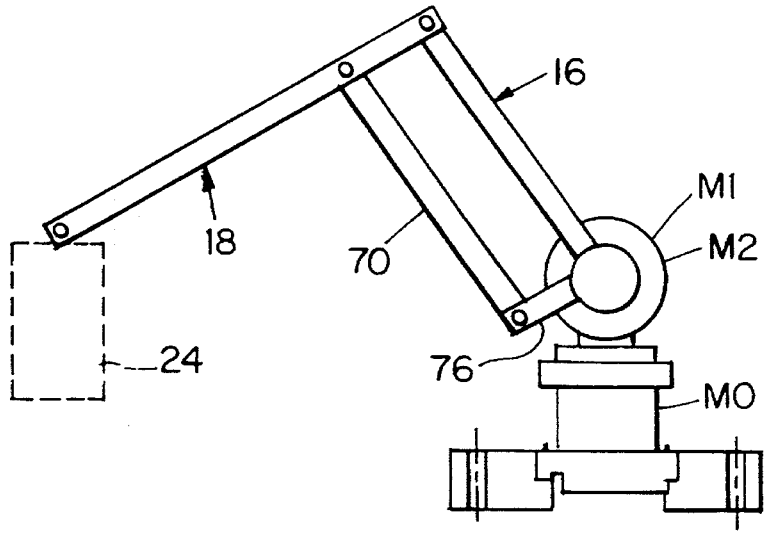
Figure 4F:
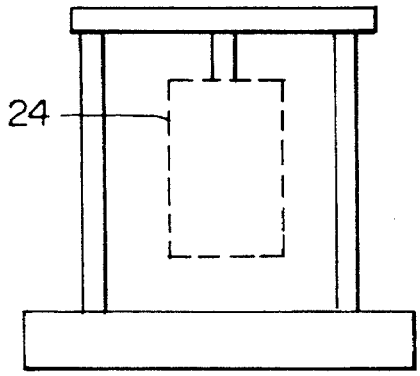

Referring to FIGS. 4*d*, 4*e* and 4*f*, end-effector 24 was built according to a modular concept. It can be assembled in the 2D version, in the 3D version and in the stand-alone version.

Figure 5A:
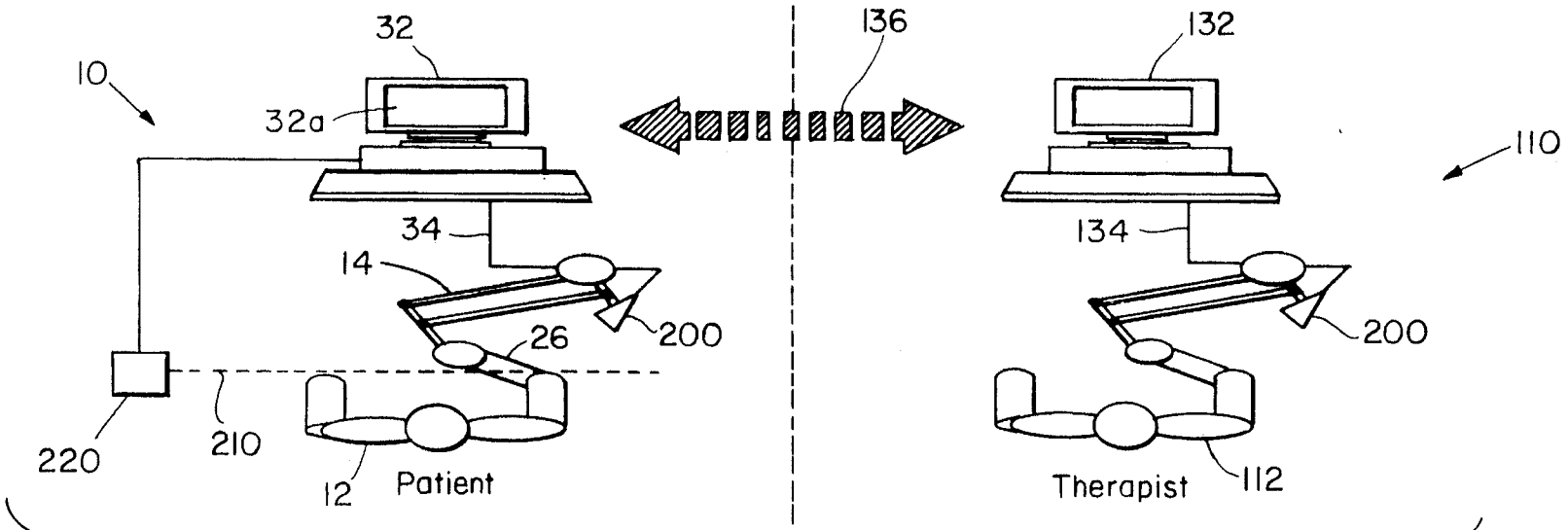
FIGS. 5*a* and 5*b* are schematic drawings of a first interactive robotic therapist controlled by a second interactive robotic therapist.
Figure 5B:
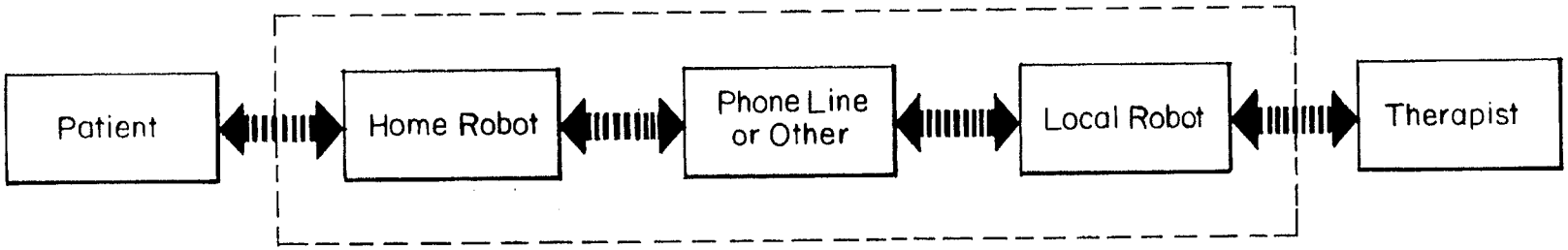

Referring to FIGS. 5*a* and 5*b*, the robotic therapist 10 to which patient 12 is secured, can be controlled by a human physical therapist 112 who is interacting with robotic therapist 110. Robotic therapist 110 is connected to computer 132 by line 134 and computer 132 is connected to computer 32 by line 136 which can be a phone line or other communication medium. As a result, therapist 112 can remotely guide the patient 12.

Figure 6:
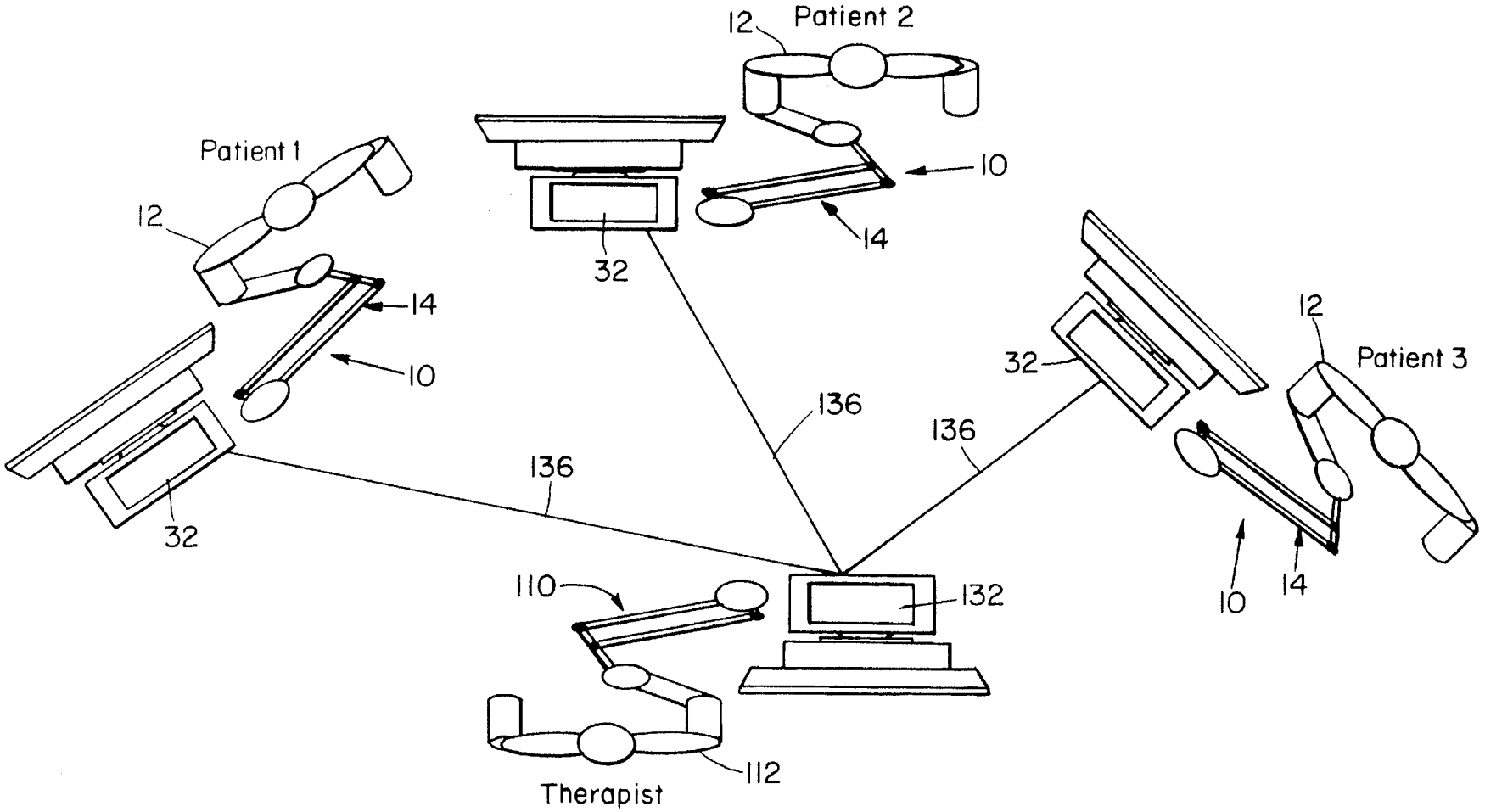
FIG. 6 is a schematic drawing of a classroom of therapy patients interacting with individual interactive robotic therapists which are controlled by a single interactive robotic therapist.

Robotic therapists 10 and 110 can optionally include cameras and sound systems 200 so that patient 12 and therapist 112 can see and talk to each other. Additionally, robotic therapist can include a range system 220 for shutting down robotic therapist 10 if a portion of the body of patient 12 other than forearm 26 crosses plane 210, thereby providing a safety feature. The same system 220 can be also used as a measuring device providing space position information of the patient's arm. Referring to FIG. 6, a single human therapist 112 operating a robotic therapist 110 can teach a classroom of patients 12 by connecting multiple computers 32 to computer 132 via lines 136.

Figure 7:
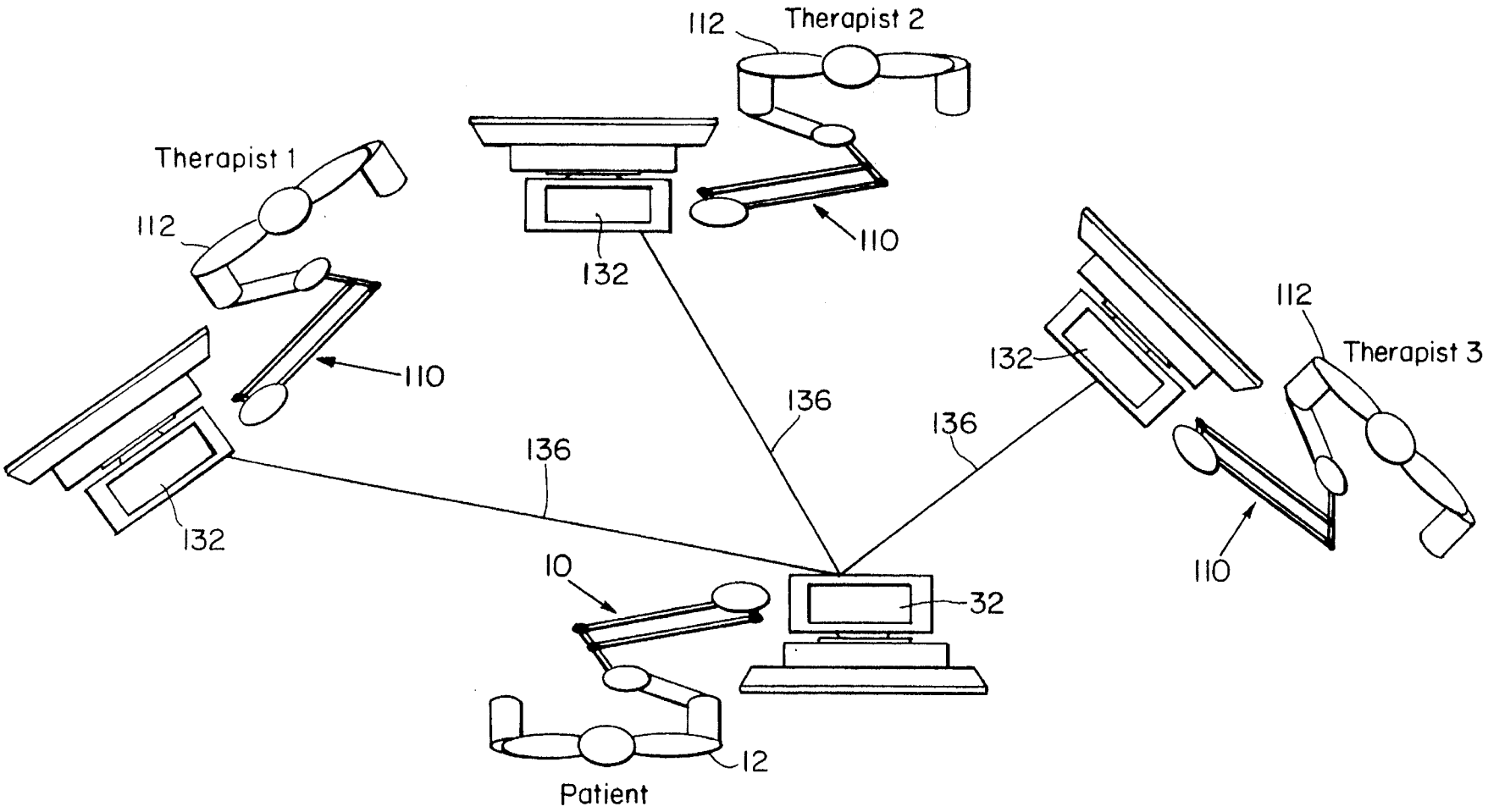
FIG. 7 is a schematic drawing of a classroom of therapists interacting with individual interactive robotic therapists and interacting with a single interactive robotic therapist attached to a patient.

Referring to FIG. 7, several human therapists 112 operating robotic therapists 110 can be trained simultaneously by a human therapist instructor 112 interacting with a patient 12 connected to the robotic therapist 10 by connecting multiple computers 132 to computer 32 via lines 136.

Figure 8B:
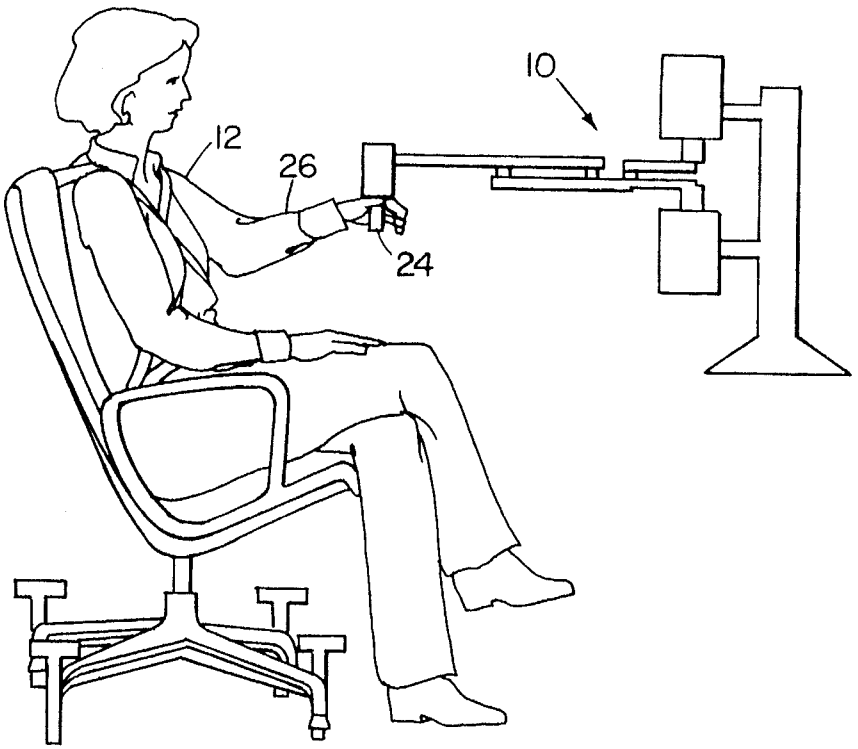
FIGS. 8*a* and 8*b* are side views of a patient using his/her intact limb to teach the interactive robotic therapist an exercise, which is mirrored by the device and played back to the impaired limb of the patient.
Figure 8A:
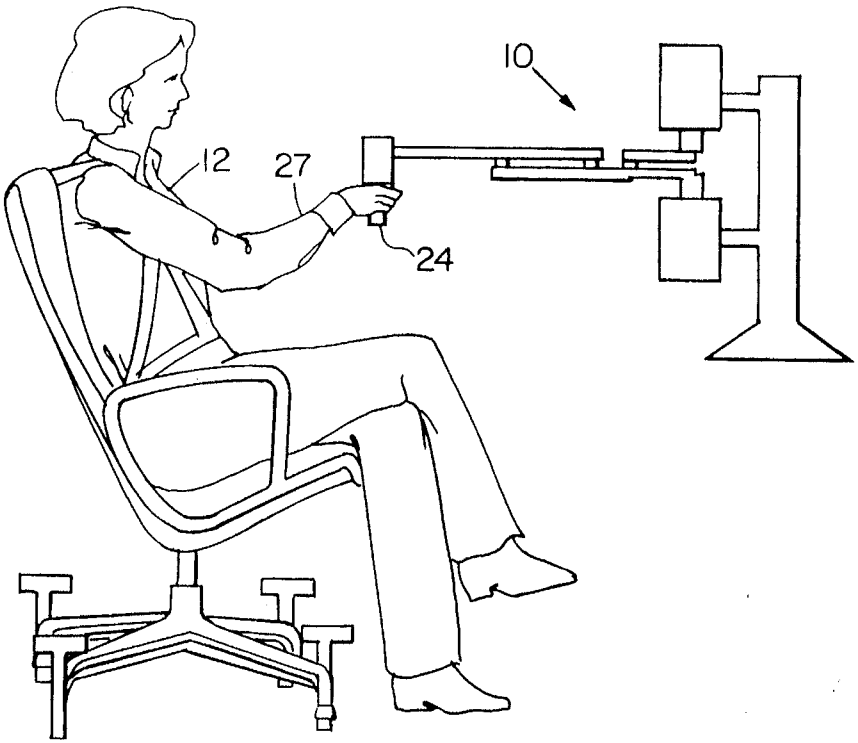

Referring to FIGS. 8*a* and 8*b*, a patient 12 can exercise alone with the interactive robotic therapist 10 by teaching the robotic therapist 10 an exercise with his/her intact limb 27. The robotic therapist 10 creates a mirror exercise for the patient's impaired limb 26 and plays it back to the patient 12.

Figure 9A:
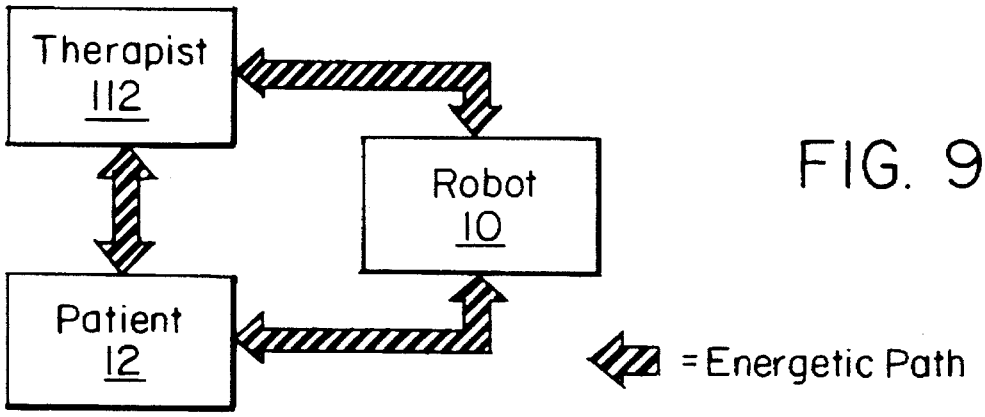
FIGS. 9*a*–9*c* are schematic drawings of different modes of therapy for the therapy.
Figure 9B:
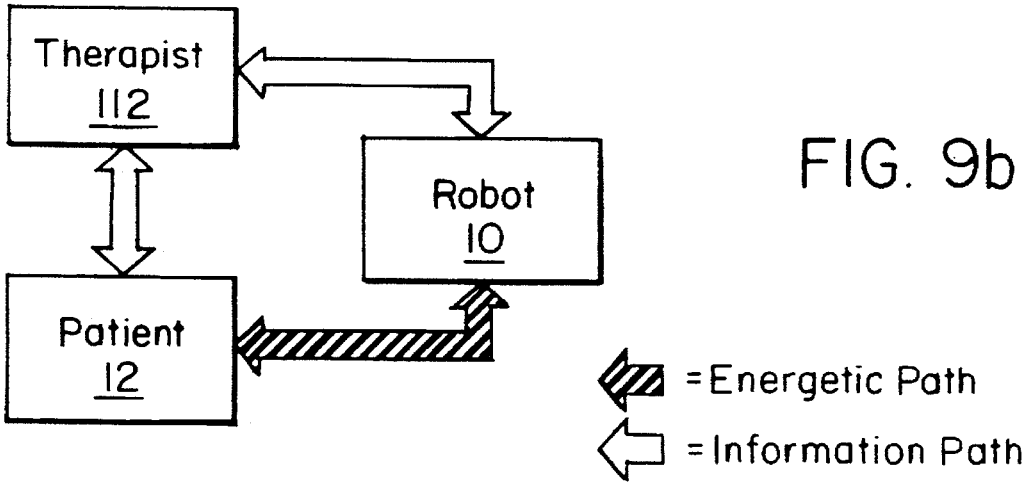
Figure 9C:
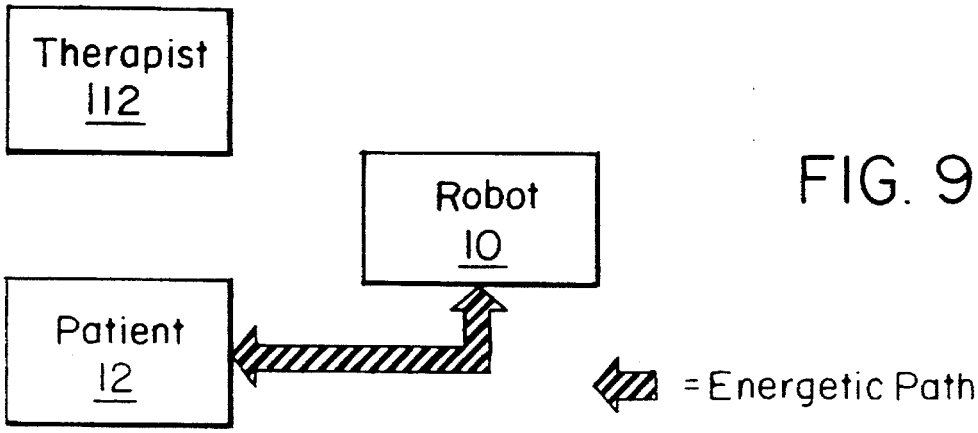

Referring to FIGS. 9*a*, 9*b* and 9*c*, the standard teach and playback procedure (intimate, monitored and autonomous modes) is illustrated. In the intimate mode the human therapist 112 teaches an exercise to the patient 12 with the robotic therapist 10 attached. The robotic therapist 10 plays back the exercise to the patient 12 with the therapist 112 still physically connected but not interfering (monitored mode). The robotic therapist 10 plays back the exercise with the therapist 112 only overseeing (autonomous).

Figure 10A:
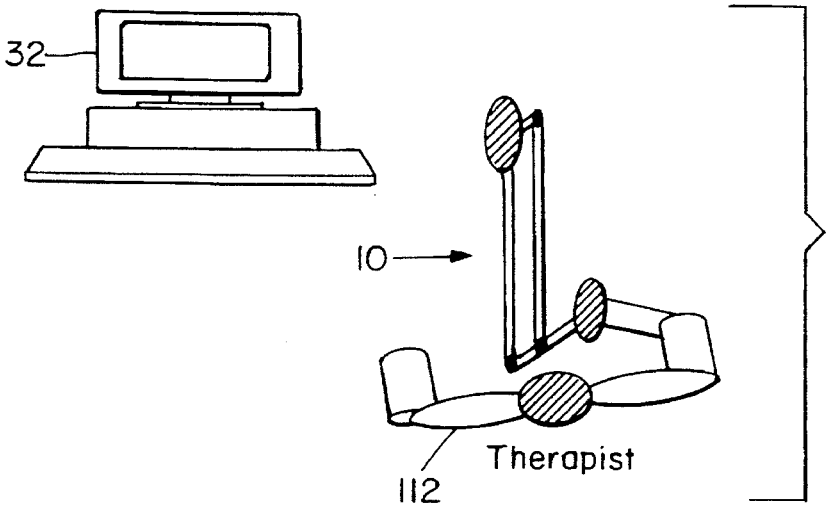
FIGS. 10*a*–10*c* are schematic drawings of the procedure for asynchronous diagnosis of patients.
Figure 10B:
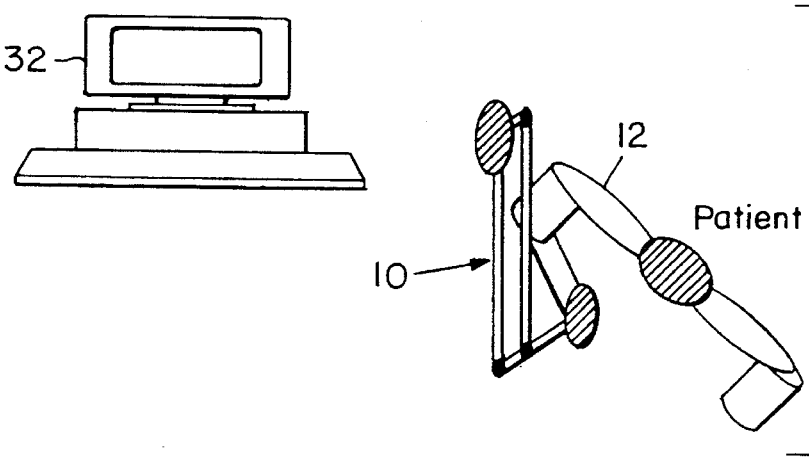
Figure 10C:
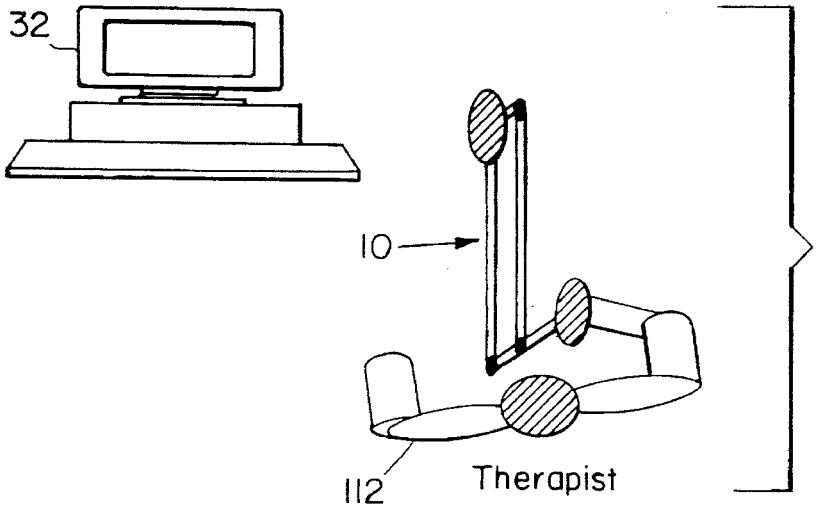

Referring to FIGS. 10*a*, 10*b* and 10*c*, the robotic therapist 10 can be used for asyncronous diagnosis and evaluation of the patient 12. In the teach mode, the human therapist 112 preprograms an exercise for robotic therapist 10. In the autonomous mode, the robotic therapist 10 plays the exercise back and registers the patient 12 reaction. In the diagnosis mode, the robotic therapist 10 plays the patient reaction to the therapist 112. The therapist 112 can diagnose or evaluate the patient 12 performance.

Figure 11A:
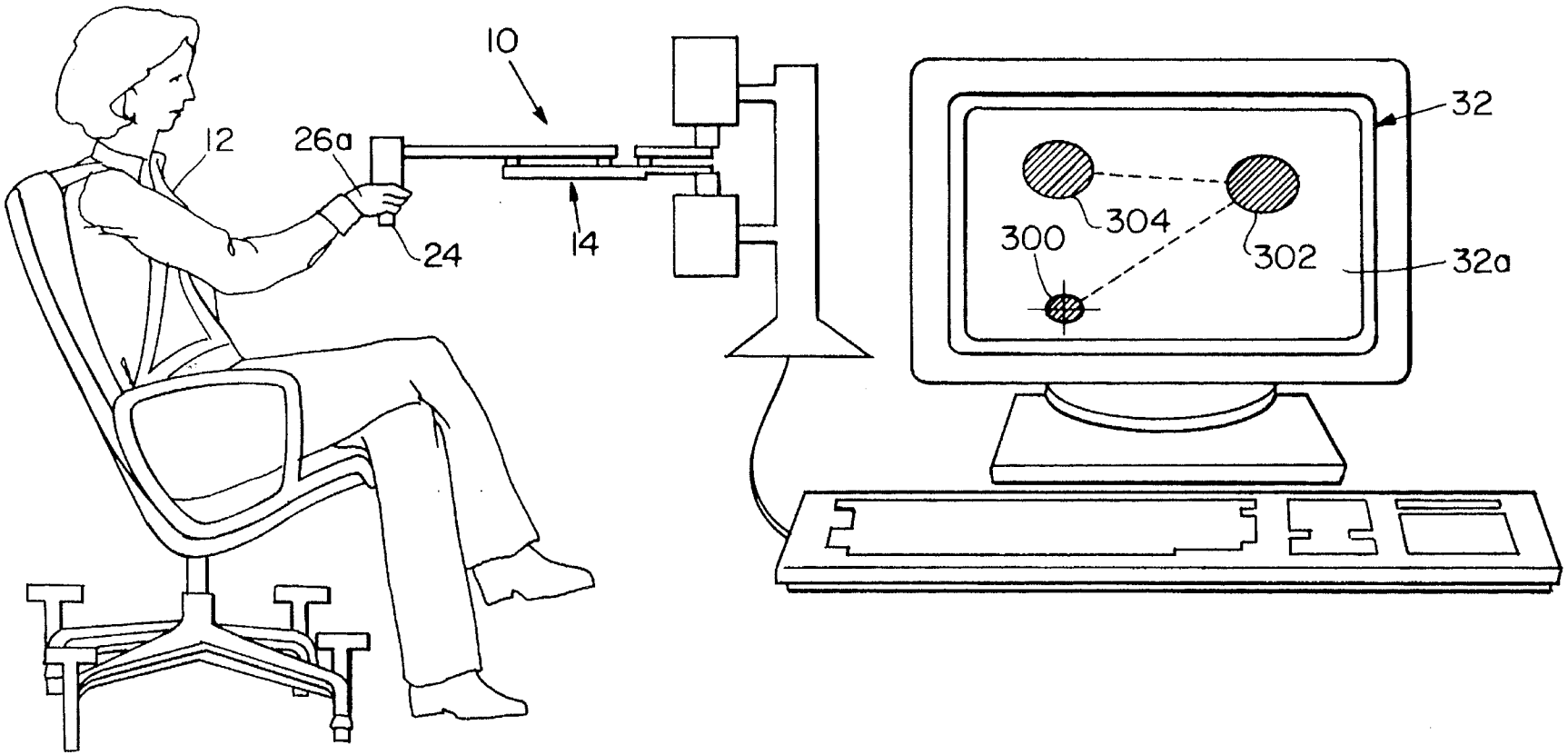
FIGS. 11*a*–11*d* show different educational video-games to motivate and register patient performance during the exercise.

Referring to FIG. 11*a*, several educational video-games can be used for the patient 12. The games have several purposes: motivation for continuing exercising, cognitive exercise, and recording patient performance during exercise. Several educational video-games were developed for range of motion, force, direction and dexterity control. The patient performance can be stored and evaluated.

One example of a game for developing the range of motion of a patient is depicted in FIG. 11*a*. Icon 300, representing the position of the hand 26*a* of patient 12, is positioned on screen 32*a*. Two targets 302 and 304, respecively, are located at positions away from icon 300. By moving hand 26*a* and attached robotic arm 14, patient 12 can move icon 300 over targets 302 and 304 (or be moved). The range of motion of patient 12 can be increased by locating more targets on screen 32*a*, by changing the target size, or by spacing the targets further apart.

Figure 11B:
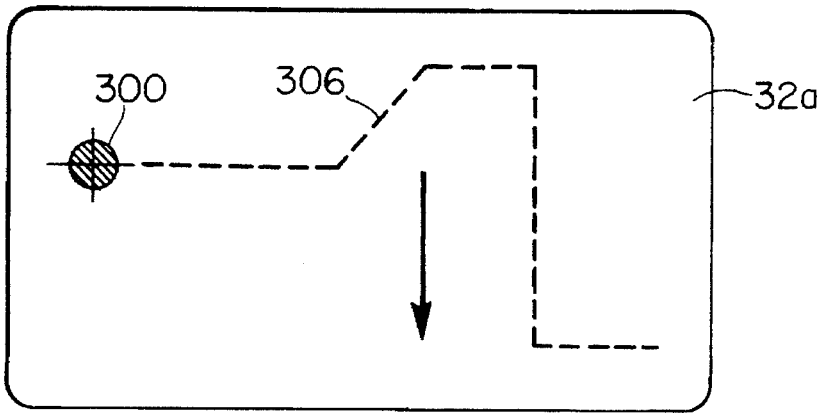

FIG. 11*b* depicts one example of a game for developing force control. Patient 12 maneuvers icon 300 along a path 306 by moving robotic arm 14, while robotic arm 14 applies a variable force against hand 26*a* in the direction of the arrow.

Figure 11C:
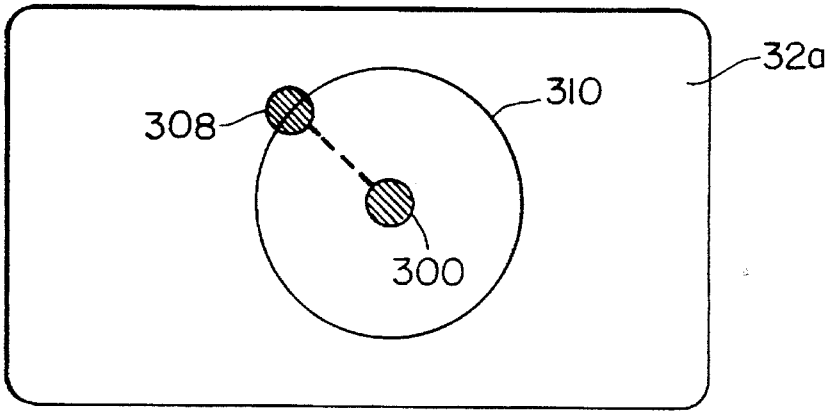

FIG. 11*c* depicts one example of a game for developing direction control. A target 308 is located in a predetermined direction away from icon 300. Patient 12 must maneuver icon 300 with robotic arm 14 in the direction of target 308 and place icon 300 over target 308. Target 308 can be located anywhere on circle 310 to develop directional control in all directions.

Figure 11D:
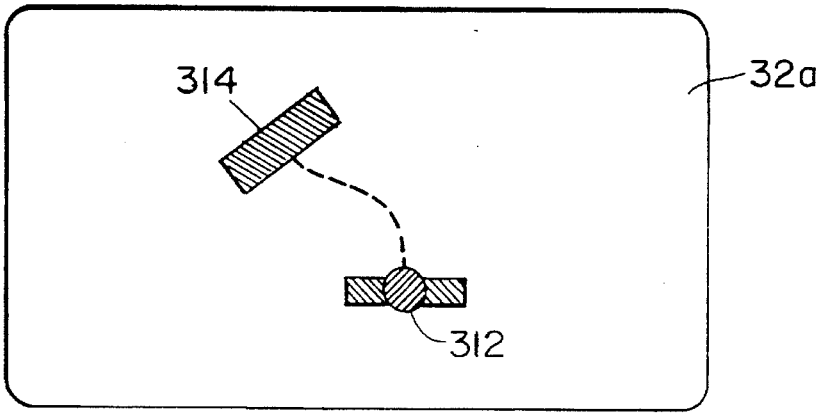

FIG. 11*d* depicts one example of a game for developing dexterity. Icon 312 designates the location of the hand 26*a* of patient 12. Icon 312 has a shape which allows the rotational orientation of icon 312 to be seen. A target 314 having a shape indicating rotational orientation is positioned away from icon 312. In order for icon 312 to be placed over target 314, icon 312 must be moved and rotated by patient 12, so that icon 312 is placed over target 314 in the same rotational orientation as target 314.

Although several video games have been described for developing the range of motion, force, direction and dexterity control of patient 12, there are countless possibilities for video games. The patient's performance in the games can be quantified and stored for patient's evaluation.

Figure 12A:
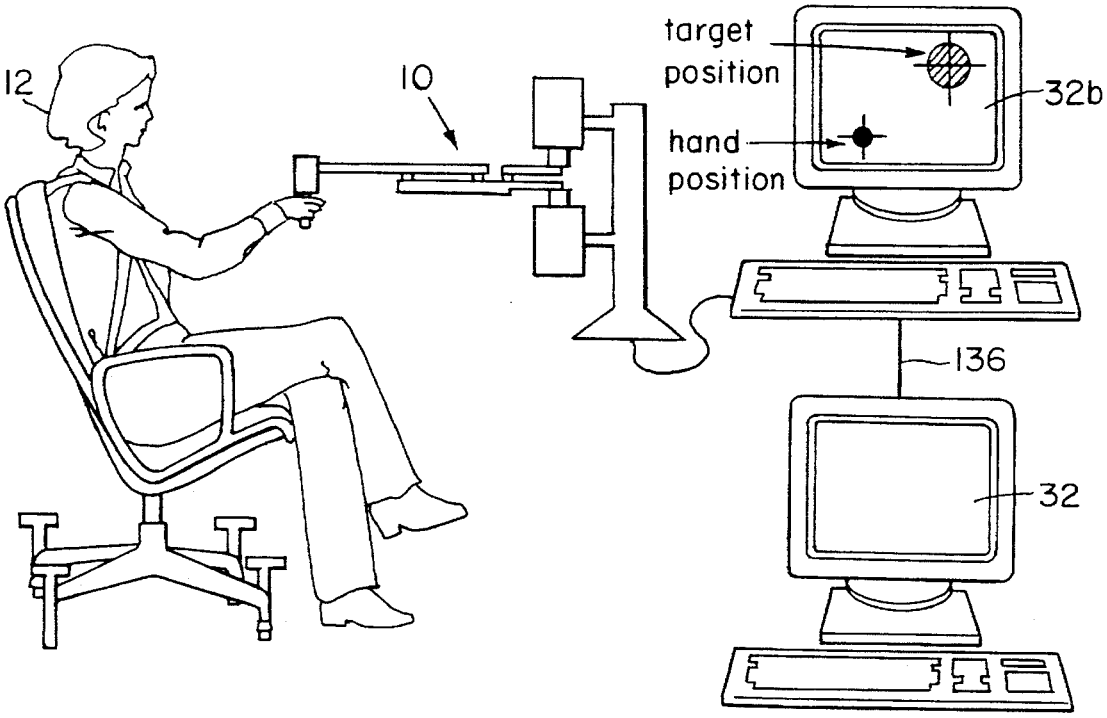
FIGS. 12*a* and 12*b* are side views showing different options for the video game screen position such as a standard vertical monitor or a horizontal monitor to facilitate the patient's visualization of the exercise and his/her hand.
Figure 12B:
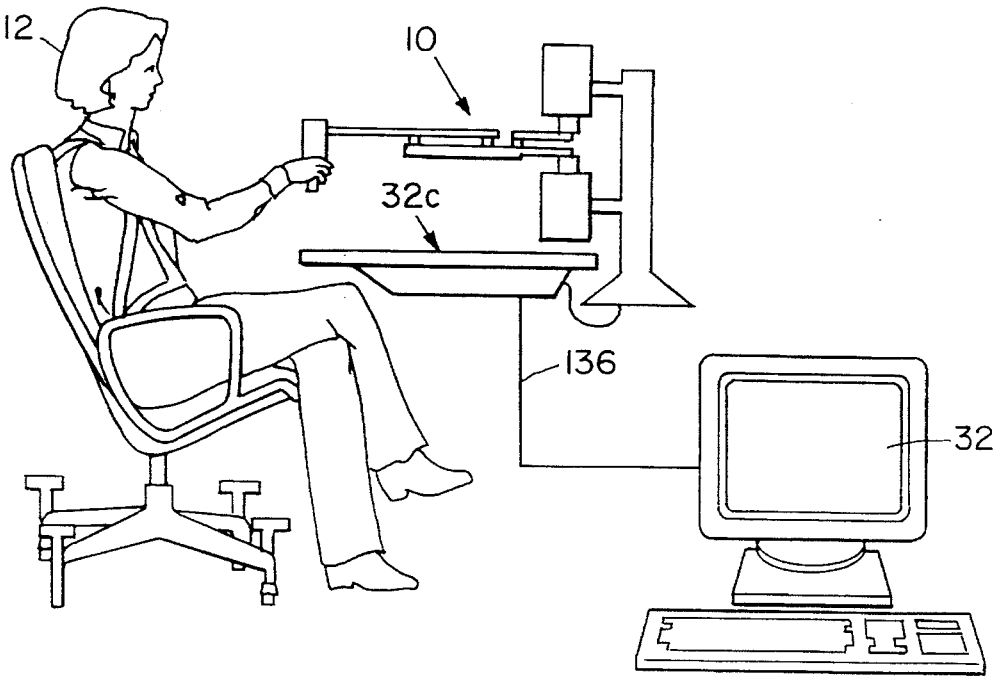

Referring to FIGS. 12*a* and 12*b*, the interactive robotic therapist 10 can have only one computer screen or monitor. However, the preferred embodiment has two separate monitors. One for the robot control system 32 and one for the educational video-game 32*b* or 32*c*. The video-game monitor can be the standard 14" computer screen 32*b*, or it can be a 21" screen 32*c* mounted horizontally just below the patient workspace to facilitate and permit the patient at look simultaneously to his/her arm and video-game screen.

Figure 13:
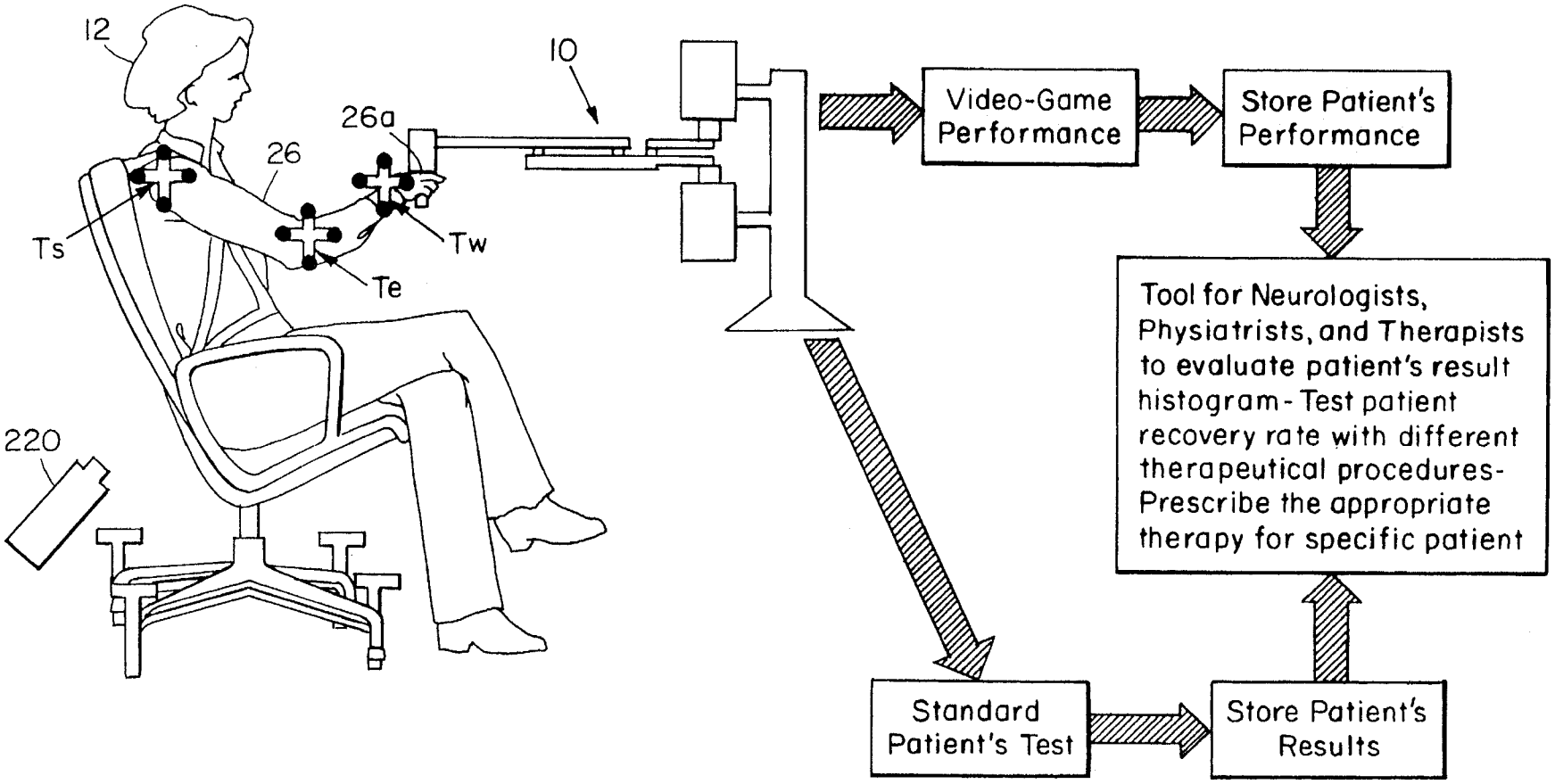
FIG. 13 is a schematic drawing showing the interactive robotic therapist as a quantification and measuring device.

Referring to FIG. 13, the interactive robot therapist 10 can be used as a measuring device for therapy quantification. It provides position, velocity, force information at the patient's hand 26*a*. It can also provide the patient's arm position information through the off-the-shelf range system 220 and targets, which are located at the shoulder (Ts), elbow (Te), and wrist (Tw). It can register the patient 12 performance and permit the evaluation of different therapy procedures.

Figure 14:
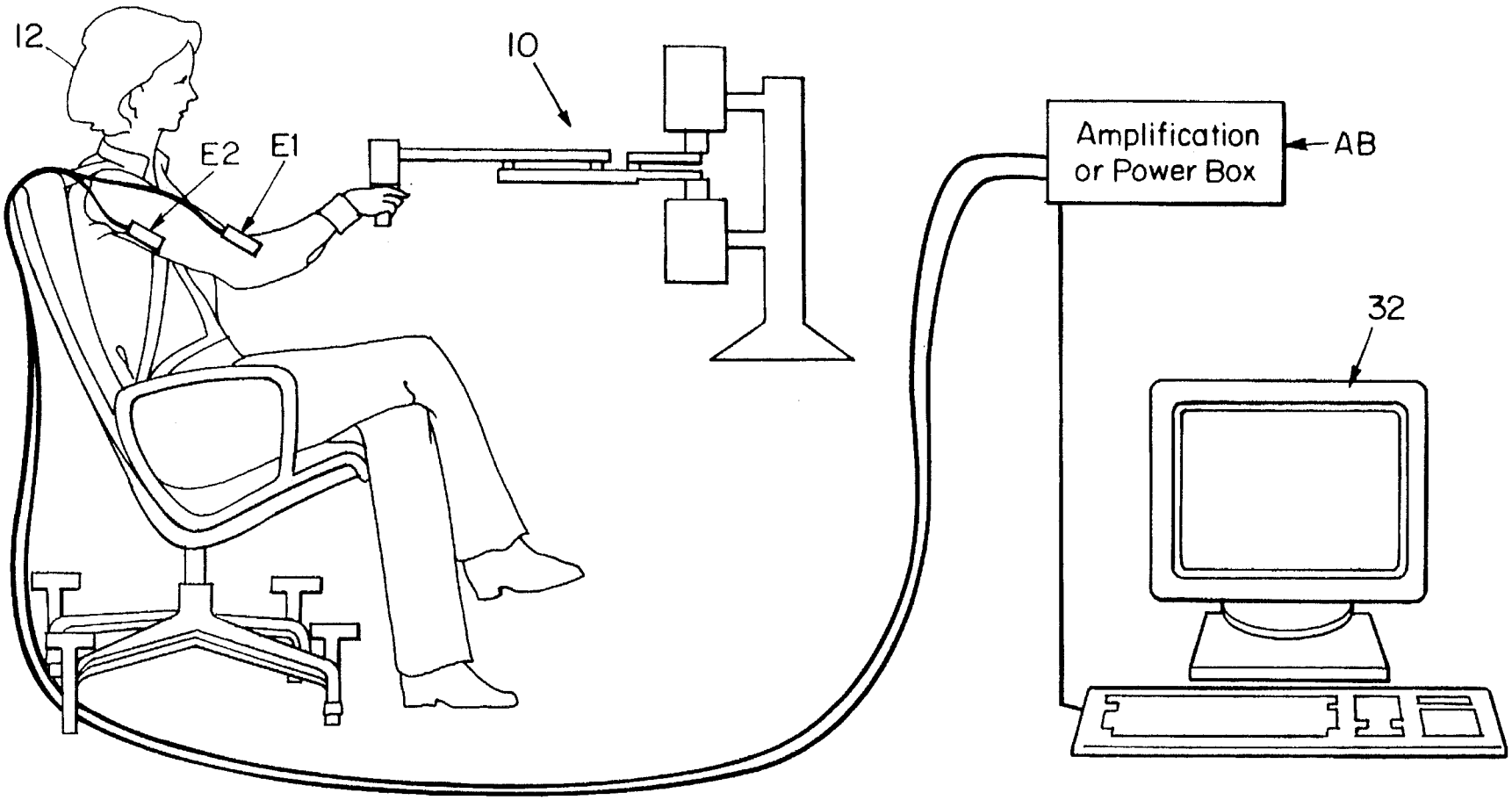
FIG. 14 is a schematic drawing showing the interactive robotic therapist as a quantification and measuring device with the additional Electromyographic implementation feature and with a Functional Electric Stimulation Implementation feature.

Referring to FIG. 14, the interactive robotic therapist 10 can also incorporate off-the-shelf electromyographic system for measuring muscle contraction, or off-the-shelf functional eletrical stimulation system to stimulate specific muscles. Both systems are illustrated by the electrodes E1, E2 and amplification or power source AB.

Figure 15A:
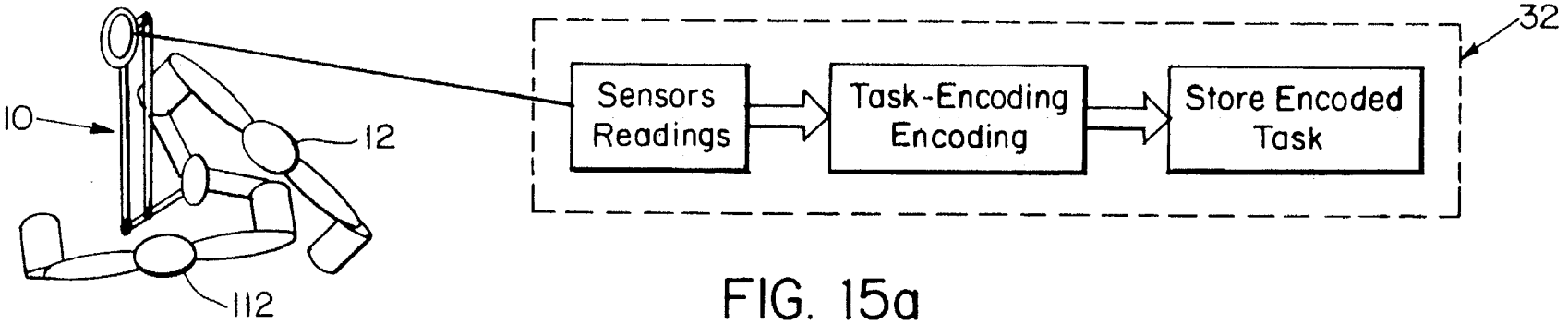
FIGS. 15*a* and 15*b* are schematic drawings showing the modules used during the teaching (intimate mode) and playback phases (autonomous and monitored modes).
Figure 15B:
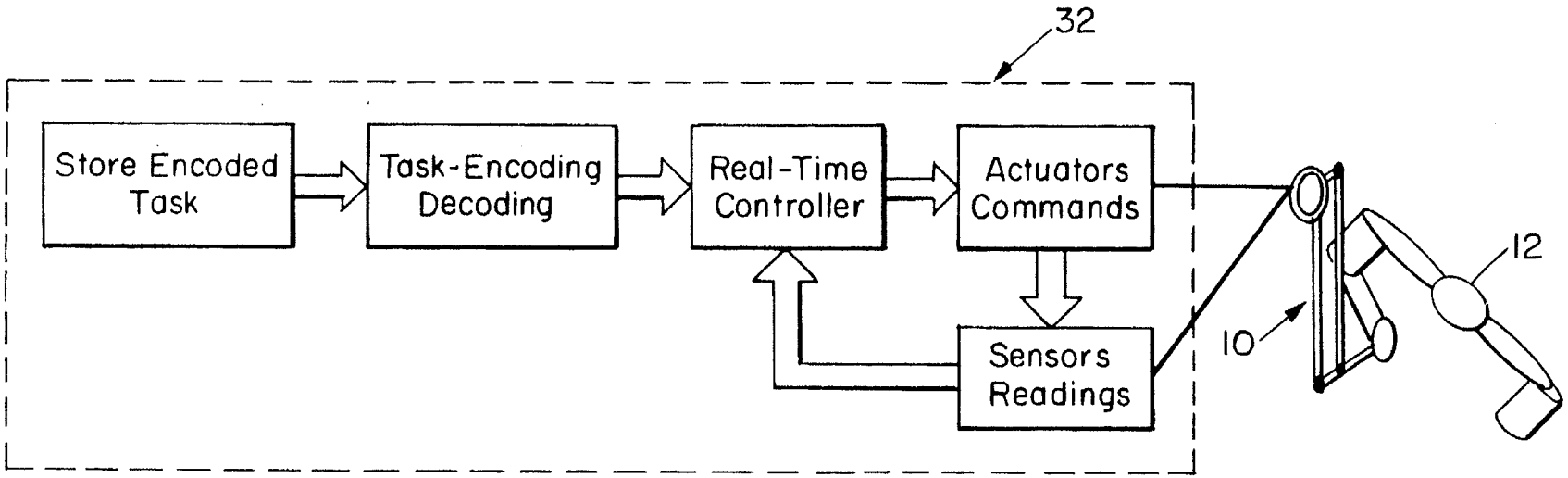

Referring to FIGS. 15*a* and 15*b*, the system flow chart is shown for the intimate and autonomous/monitored modes of FIGS. 9*a*–9*c*. In the intimate mode the sensor readings are encoded through a set of human-like motion primitives and stored. In the autonomous or monitored modes, the stored information is decoded and the desired motion characteristic is reconstructed. This desired motion characteristic is target motion that the real-time controller tries to achieve by sending commands to the actuators and using the sensors feedback to calculate the new set of commands.

Figure 16:
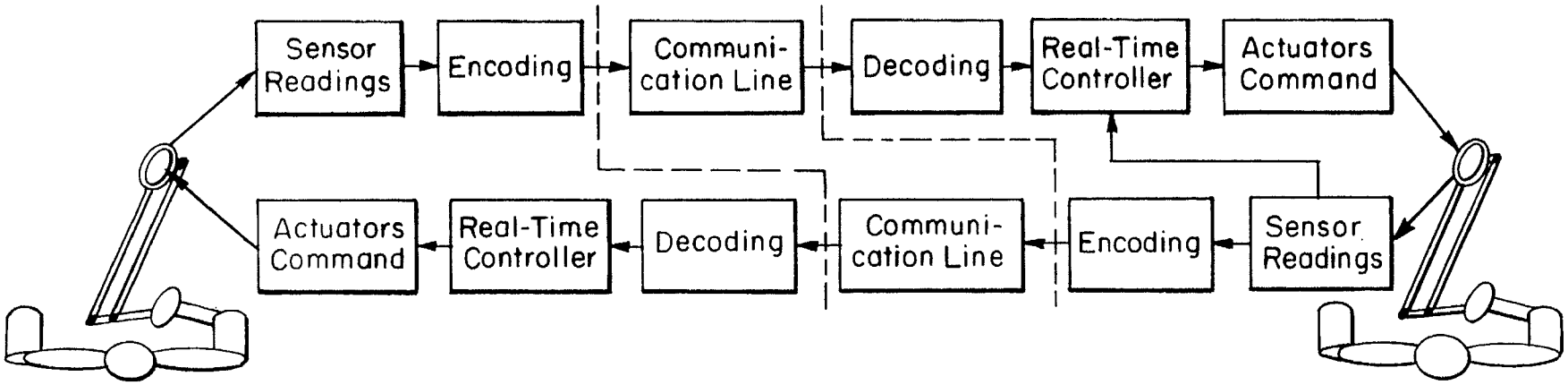
FIG. 16 is a schematic drawing showing the modules used in telerobotic implementation.

Referring to FIG. 16, the system flow chart is shown for the telerobotic implementation. The sensor readings are used in two forms: to provide feedback for the local real-time controller and to encode the motion into human-like primitives, sent through a transmission line. At the other side of the transmission line, the message is decoded and the desired motion characteristic is used by the real-time controller to send commands to the actuators, and using the sensors feedback to calculate the new set of commands.

The interactive robotic therapist tries to mimic the human therapist. The controller schemes illustrated in the previous figures incorporate psycho-physical experimental results and hypothesis on primate motor control (humans and monkeys). This prior knowledge of human motor control is incorporated in different forms into the robotic therapist. The preferred controller of FIG. 2 incorporates the concept that motor behavior is hierarchically organized in the sequence of layers: volitional or object domain, kinematic domain (mapping of the task), and torque/force domain. The human-like motion primitives mentioned in the encoding scheme of FIGS. 15*a* through 16 incorporates the concept of encoding movement via a virtual trajectory. The virtual trajectory for unconstrained motions minimizes jerk, and the arm trajectory modification scheme incorporates the concept of virtual trajectory superposition. The resulting virtual trajectory and impedance estimates are then coded in a sequence of minimum jerk type components (or similar basis function, such as Gaussian or Wavelet functions). The concept of "stroke" will be used to aggregate these components. Stroke can be loosely defined as an action unit. A stroke will be represented by an episodic burst of information, whenever a new action is required.

Equivalents

While this invention has been particularly shown and described with references to preferred embodiments thereof, it will be understood by those skilled in the art that various changes and form and details may be made therein without departing from the spirit and scope of the invention as defined by the dependent claims. For example, various types of motors and actuators can be substituted for motors M0, M1, M2 and M3. Additionally, motors M0, M1, M2 and M3 can be positioned at other suitable locations and robotic arm 14 can be of various configurations. Furthermore, robotic therapist 10 can be employed to rehabilitate other parts of a patient's body such as the legs. Also, end-effector 24 does not have to provide three degrees of freedom at the wrist, but can be of other suitable configurations such as a handle which the patient grips.

What is claimed is:

1. An interactive robotic therapist system comprising at least one interactive robotic therapist including:

a robotic moveable member for interacting with a patient to shape the patient's motor skills, the moveable member including an end-effector with a limb coupler for securing a patient's limb to the moveable member at the end-effector, the moveable member being capable of guiding the patient's limb along a desired path through a series of desired exercises;

a drive system coupled to the moveable member for driving the moveable member, the drive system being configured such that force exerted by the patient's limb on the moveable member is capable of altering the desired path of the moveable member while the moveable member is guiding the patient's limb through the exercises without changing the series of the desired exercises wherein the patient can be safely connected with the moveable member since the patient can temporarily alter the desired path of the moveable member; and a controller coupled to the drive system for providing the drive system with commands to direct the moveable member through the series of desired exercises.

2. The robotic therapist of claim 1 in which the moveable member is a robotic arm having a series of moveable joints.

3. The robotic therapist of claim 1 in which the controller has programming means for programming the series of exercises are.

4. The robotic therapist of claim 2 in which the drive system comprises at least one drive motor coupled to at least one joint in the robotic arm.

5. The robotic therapist of claim 1 in which the controller has memory means for storing the desired series of exercises.

6. The robotic therapist of claim 2 in which the robotic arm has more than one degree of freedom.

7. The robotic therapist of claim 1 in which the robotic therapist is a first robotic therapist and further comprising a second robotic therapist for controlling the movements of the first robotic therapist through command signals communicated over a communication line.

8. The robotic therapist of claim 1 further comprising educational video-games displayed on a monitor and playable by the patient through manipulation of the moveable member.

9. The robotic therapist of claim 1 in which the controller includes means for measuring and quantifying motor skill performance of the patient.

10. The robotic therapist of claim 1 in which only the end-effector has means for securing the patient's limb.

11. A method of shaping a patient's motor skills comprising the steps of providing an interactive robotic therapist system comprising at least one interactive robotic therapist including a robotic moveable member, a drive system coupled to the moveable member and a controller coupled to the drive system;

guiding a patient's limb along a desired path through a series of exercises with the moveable member secured to the patient's limb, the moveable member being driven by the drive system coupled to the moveable member;

controlling the drive system with a controller, a controller providing commands to direct the moveable member through the desired series of exercises; and altering the desired path of moveable member while the moveable member is guiding the patient's limb through the exercises by exerting force on the moveable member with the patient's limb without changing the series of the desired exercises wherein the patient can be safely connected with the moveable member since the patient can temporarily alter the desired path of the moveable member.

12. The method of claim 11 further comprising the steps of:

teaching a series of exercises to the interactive therapy apparatus by guiding the moveable member through a series of motions; and storing the guided series of motions in memory in the controller.

13. The method of claim 11 in which the series of exercises are predetermined.

14. The method of claim 11 in which the patient's limb is an arm.

15. The method of claim 13 in which the patient's arm is guided by the moveable member through a full range of motion.

16. The method of claim 11 further comprising the step of providing educational video games displayed on a monitor and playable by the patient through manipulation of the moveable member.

17. The method of claim 11 further comprising the step of measuring and quantifying motor skill performance of the patient with the controller.

18. The method of claim 11 in which the patient's motor skills are shaped with a first robotic therapist, the method further comprising the step of controlling the movements of the first robotic therapist with a second robotic therapist through command signals communicated over a communication line.

19. The method of claim 11 further comprising the step of providing the moveable member with more than one degree of freedom.

20. The method of claim 11 further comprising the step of coupling at least one drive motor to at least one joint in the moveable member to form the drive system.

* * * * *

UNITED STATES PATENT AND TRADEMARK OFFICE

CERTIFICATE OF CORRECTION

PATENT NO. : 5,466,213

DATED : Nov. 14, 1995

INVENTOR(S) : Neville Hogan, Hermano I. Krebs, Andre Sharon and Jain Charnnarong It is certified that error appears in the above-indentified patent and that said Letters Patent is hereby corrected as shown below:

Col. 8, lines 39-43, "providing an interactive robotic therapist system comprising at least one interactive robotic therapist including a robotic moveable member, a drive system coupled to the moveable member and a controller coupled to the drive system" should be a separate paragraph.

Col. 8, line 49, delete "a" and insert --the--.

Signed and Sealed this

Sixth Day of February, 1996

*Attest:*

*Attesting Officer*

BRUCE LEHMAN

*Commissioner of Patents and Trademarks*